US005685630A

United States Patent [19]

Herman

[11] Patent Number: 5,685,630

[45] Date of Patent: Nov. 11, 1997

[54] BATTERY-OPERATED AUTOMATICALLY SWITCHED LIGHTING DEVICE

[76] Inventor: Trent S. Herman, 4440 Meigs, Waterford, Mich. 48329

[21] Appl. No.: 495,864

[22] Filed: Jun. 28, 1995

Related U.S. Application Data

[63] Continuation of Ser. No. 323,894, Oct. 17, 1994, abandoned.

[51] Int. Cl.[6] ..... F21V 23/04

[52] U.S. Cl. ..... 362/155; 362/201; 362/802; 200/61.62; 200/61.81

[58] Field of Search ..... 362/94, 100, 137, 362/155, 200, 201, 802; 200/61.41, 61.62, 61.71, 61.73, 61.76, 61.78, 61.81

[56] References Cited

U.S. PATENT DOCUMENTS

| | | | |
|---|---|---|---|
| 2,156,443 | 5/1939 | Zook | 362/200 |
| 2,279,933 | 4/1942 | Wells | 200/61.81 |
| 2,411,100 | 11/1946 | Macdonald | 362/155 |
| 2,486,909 | 11/1949 | Babajoff | 362/200 |
| 2,774,860 | 12/1956 | Prebol et al. | 362/191 |
| 3,711,694 | 1/1973 | Gronauer | 362/802 |
| 3,787,677 | 1/1974 | Molitor | 362/200 |
| 4,442,478 | 4/1984 | Stansbury | 362/200 |
| 4,847,738 | 7/1989 | Nehl | 362/200 |
| 4,858,084 | 8/1989 | Sheryll | 362/802 |
| 5,032,957 | 7/1991 | Canfield | 362/133 |

*Primary Examiner*—Ira S. Lazarus
*Assistant Examiner*—Sara Sachie Raab
*Attorney, Agent, or Firm*—John R. Benefiel

[57] ABSTRACT

A battery-operated automatically switched lighting device is provided for illumination of the interior of enclosures provided with doors, such as for closets, cupboards, cabinets, and the like. Identical light transmitting housing parts are assembled together to contain batteries, a light bulb, and formed metal strips acting as contacts and switch actuator when the enclosure door is opened and closed. Various protrusions projecting from the bottom wall of each housing part together form battery, bulb, housing, and contact strip locating features, and molded locking tabs snap fit together to releasably hold the housing parts together.

11 Claims, 5 Drawing Sheets

FIG. 4
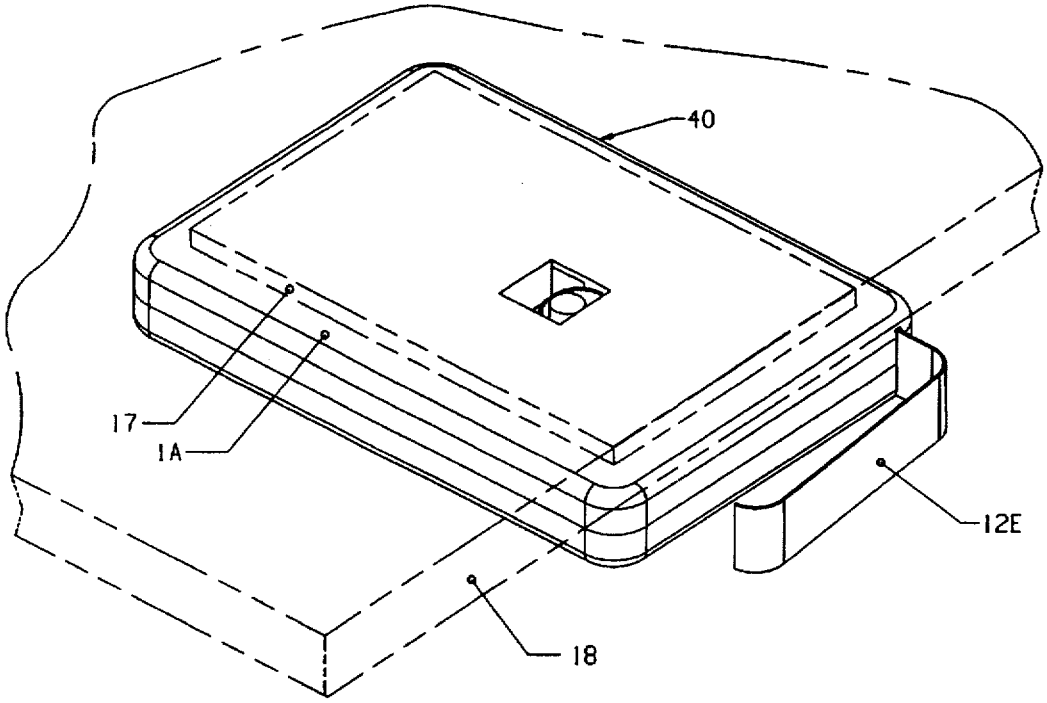
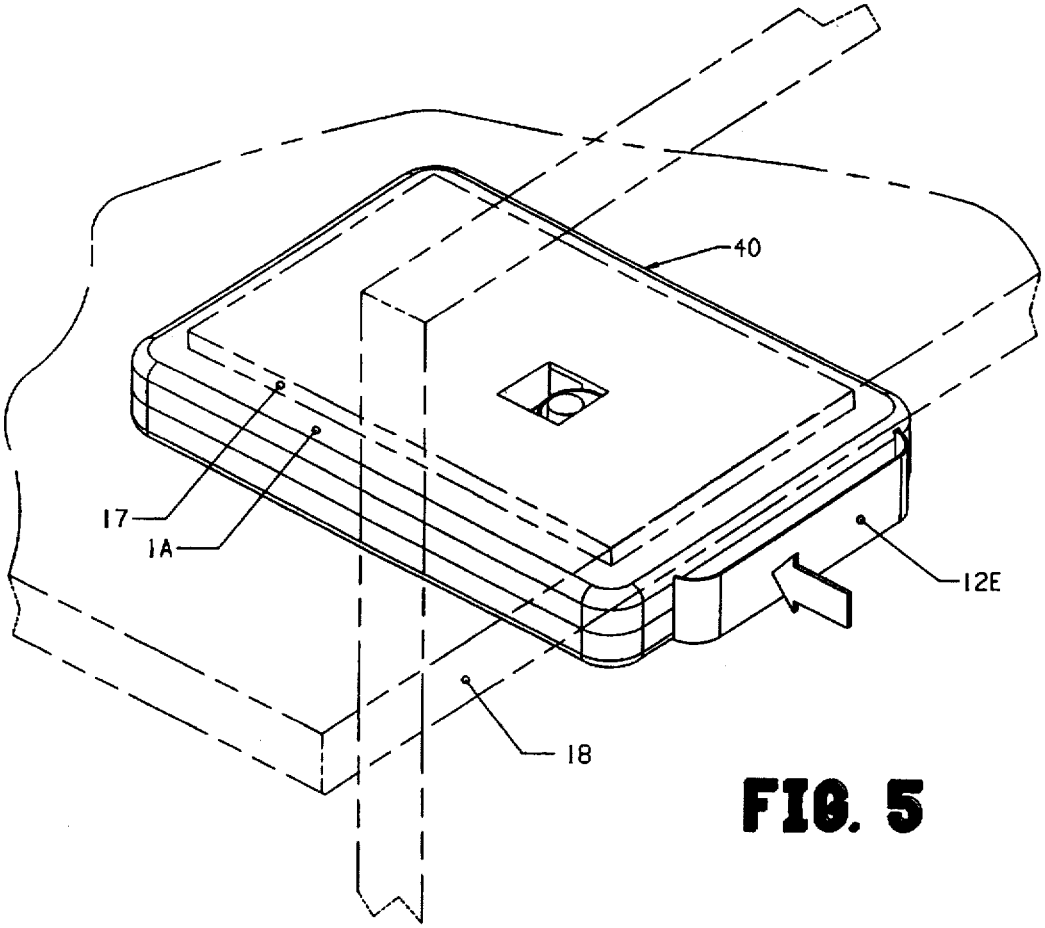
FIG. 5

BATTERY-OPERATED AUTOMATICALLY SWITCHED LIGHTING DEVICE

CROSS REFERENCE TO RELATED APPLICATION

This application is a continuation of Ser. No. 08/323,894, filed Oct. 17, 1994, now abandoned.

BACKGROUND OF THE INVENTION

1. Field of the Invention

This invention concerns battery-powered lights for illuminating the interior of an enclosure, such as, for example, a closet or cupboard, which are switched on and off by opening and closing of a door.

2. Description of the Prior Art

There are numerous prior patents describing automatically switched, battery-operated lights for installation in enclosures to conveniently provide illumination of the enclosure interior. However, the devices shown in the prior patents are relatively complex having numerous parts which must be assembled together.

Zook, U.S. Pat. No. 2,156,443; Wells, U.S. Pat. No. 2,279,933; Macdonald, U.S. Pat. No. 2,411,100; Molitor, U.S. Pat. No. 3,787,677; Stansbury, U.S. Pat. No. 4,442,478; Nehl, U.S. Pat. No. 4,847,738; and Canfield, U.S. Pat. No. 5,032,957 all contain numerous parts such as multi-part housings, plungers, switches, springs, light bulb lenses and reflectors, all contributing to a complex mechanical design.

By comparison, both Babjoff, U.S. Pat. No. 2,486,909 and Prebol et al, U.S. Pat. No. 2,774,860 present a compact size and few parts, but both still require two unique housing parts and both use a separate plunger to operate the on/off switch.

The object of the present invention is to provide an easily mountable, battery-operated, automatically switched light of a simple design able to be manufactured at low cost.

SUMMARY OF THE INVENTION

The present invention is comprised of a light operated by two batteries enclosed in a housing space defined by two identical housing parts snap-fit together. The two housing parts are tray-shaped and comprise rectangular, rimmed pieces, held together with their rim edges in abutment. In that position, a series of molded protrusions project upwardly from the bottom wall of each housing part together define locating features for locating the internal components and housing parts with their aligned rims abutting each other to define the enclosed housing space.

A pair of hook end protrusions are oppositely facing when the housing parts are assembled, and are configured to snap together to releasably hold the housing parts together.

Disposed within the housing enclosed space are two differently shaped formed flat metal strip contacts held on edge by a series of mating protrusions projecting from the bottom wall of each housing part defining gaps between which the strip contacts are held.

A pair of batteries are similarly held in a parallel, side-by-side, but terminal-reversed position between a series of molded protrusions, with a first one of the strip contacts connecting two of the battery terminals in series.

A flashlight bulb is held in mating, suitably shaped protrusions projecting from the housing part bottom wall.

The bulb rim is held in contact with a second of the contact strips.

The second contact strip is elongated and very generally U-shaped, and has an intermediate section connected to a first section normally contacting a terminal of a second of the batteries and an end section contacting the bulb rim to complete the battery circuit and energize the device. The other end of the second contact strip protrudes out through a slot in the housing rim and is formed over to provide a switching actuator. The switching actuator is positioned during installation so as to be engaged by a door closure, causing the intermediate section to be held in a deflected condition, moving the strip out of contact with the second battery terminal to interrupt the battery circuit and deenergize the light.

Upon opening of the closure and release of the switching actuator portion of the second contact strip, the resilience of the second contact strip causes the intermediate section to relax and cause the first section to again move into contact with the second battery terminal and cause the bulb to be reenergized.

The housing parts are made of light transmitting, preferably clear plastic so that the light from the bulb provides illumination without the need for a separate lens, while completely enclosing the bulb.

The lighting device according to the invention is thus constructed of only four parts (not including the batteries and bulb), two being identical, and does not require any fasteners or other parts to be assembled.

At the same time, the lighting device according to the invention is very reliable in operation.

BRIEF DESCRIPTION OF THE DRAWINGS

FIG. 4 is an isometric view of the assembled lighting device according to the present invention shown in its mounted position under a shelf, with an enclosure shown in fragmentary form in phantom, the lighting device in a switched-on state, with the enclosure door open, the normally visible internal components omitted from the drawing for clarity.

FIG. 5 is an isometric view of the lighting device shown in FIGS. 1 through 4 with the enclosure door closed to switch off the light.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations in the scope of the appended claims.

Figure 1:
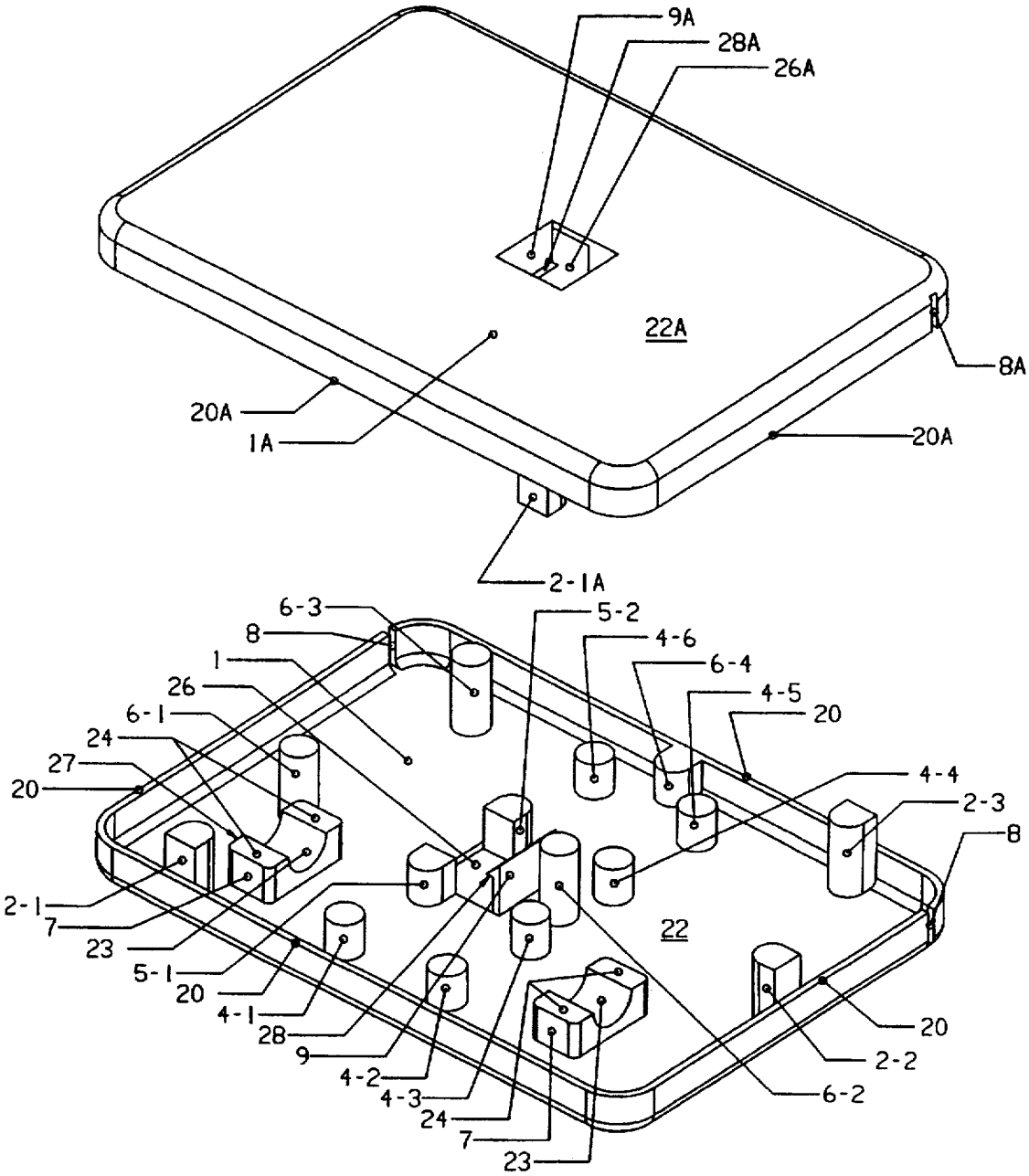
FIG. 1 is an isometric view of the two identical housing parts of the lighting device according to the present invention separated but in position for assembly.

Referring to FIG. 1, the operating components of the lighting device according to the present invention are contained within two housing parts 1 and 1A, each of identical configuration to comprise one-half of the complete housing structure. The housing parts 1 and 1A are of a molded, light-transmitting plastic to allow light from a bulb completely enclosed within housing parts 1 or 1A to provide illumination, as will be described. The parts 1, 1A are generally tray-shaped, i.e., formed by a generally rectangular bottom wall 22 having a rim 20 and 20A extending about the perimeter of the bottom wall 22. The rim 20 is interrupted on each short side with slits 8 and 8A at a location adjacent one longer side. Two of the slits 8 and 8A are aligned at assembly, forming a slot which allows a contact strip, described hereinafter, to extend out of the enclosed housing space defined by the assembled housing parts 1 and 1A to be able to function as a switching actuator as illustrated in FIG. 4.

Figure 3:
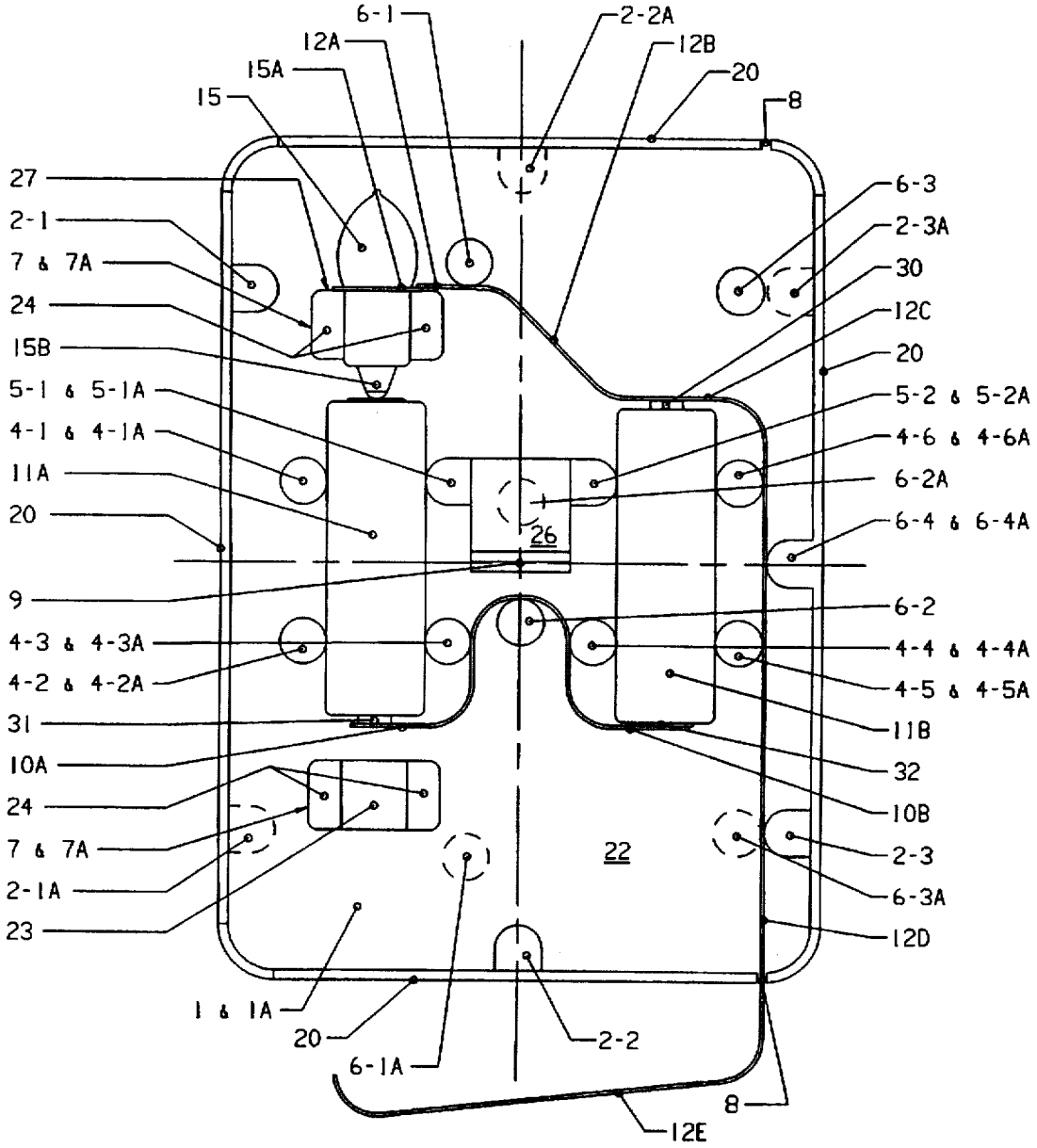
FIG. 3 is a plan view of one housing part of the lighting device according to the present invention with all of the internal components assembled therein.

Referring again to FIG. 1 and also to FIG. 3, a pattern of variously shaped and configured protrusions project upwardly from the inside of the bottom wall 22 of each housing part 1 and 1A which serve several functions, i.e., to locate the housing parts 1 and 1A to each other, to mount a bulb, to locate a pair of batteries, to guide and support two diverse contact strips, and finally to provide a means for locking the two housing parts 1 and 1A together in their assembled condition.

The protrusion pattern includes a series of asymmetrically located full-height protrusions, as well as an asymmetrically arranged series of half-height protrusions which are adapted to align with and contact the corresponding protrusion in the other housing part 1 or 1A when these parts are assembled together. The full-height protrusions extend completely across the interior space from the bottom wall 22 of one housing part 1 or 1A to the inside surface of the bottom wall 22 of the opposite housing part 1 or 1A when the housing parts 1 and 1A are assembled together.

The full-height asymmetric protrusions include three protrusions 2-1, 2-2, and 2-3 on housing part 1, and three protrusions 2-1A, 2-2A, and 2-3A on housing part 1A (see FIG. 3).

Protrusions 2-1 and 2-1A are located along one of the long sides of the bottom wall 22 adjacent a short side edge rim 20, 20A. Protrusions 2-2 and 2-2A are located centered on one of the short sides, and protrusions 2-3 and 2-3A are located along the opposite long side adjacent the other short side edge rim 20, 20A.

Each of these protrusions 2-1(A) through 2-3(A) has a flattened outer surface aligned with the inside surface of the adjacent rim 20, 20A.

The portion of the protrusion surface of 2-1 through 2-3 projecting above the rim 20 acts as a locator surface engaged within the rim 20, 20A of the opposite housing part.

It is noted that the housing parts 1 and 1A, in order to be assembled together, must be located facing each other with the rims 20 and 20A aligned, and in addition must be rotated 180° in the horizontal plane as viewed in FIG. 1, such that asymmetric pattern of the protrusions 2-1, 2-2, 2-3 and 2-1A, 2-2A, and 2-3A assume mirror image relationships on either side of the transverse centerline, i.e., protrusion 2-1 is located to the left as viewed in FIG. 1, whereas protrusion 2-1A is located to the right, and so forth.

Accordingly, the sets of protrusions 2-1, 2-2, 2-3 and 2-1A, 2-2A, 2-3A provide locating features at a total of six points, two each on the long sides of each part 1, 1A, and one each centered on the shorter sides, as can be clearly seen in FIG. 3.

Each housing part 1 and 1A also is formed with a pair of light bulb supporting seat protrusions 7 and 7A, each pair symmetrically arranged on either side of the transverse centerline of the respective housing parts. Each light bulb mounting seat 7 and 7A is formed with a semi-circular recess 23 disposed on either side of top faces 24.

Each of the light bulb seats 7 and 7A is of one-half height such that the top faces 24 abut each other with the housing parts assembled together, and the semi-circular recesses 23 form a cylindrical bore adapted to enclose the base of the light bulb, as will be described hereinafter in further detail.

Only one pair of the light bulb seats 7 and 7A are actually utilized, the other pair being superfluous and produced in order to provide identical housing parts 1 and 1A.

Also provided are symmetrically arranged patterns of half-height battery locator protrusions 4-1, 4-2, 4-3, 4-4, 4-5, 4-6, 5-1, and 5-2. Cylindrical protrusions 4-1 and 4-2, and 4-6 and 4-5 are symmetrically arranged on either side of the transverse center line, as are the protrusions 5-1 and 4-3, 5-2 and 4-4.

The protrusions 5-1 and 5-2 have a flattened side adjacent a rectangular access opening 26. The protrusion pairs 4-1, 4-2 and 5-1, 4-3, and 4-5, 4-6, and 5-2, 4-4 define an intermediate space between which the batteries can be slipped as described hereinafter. The upper housing part 1A is provided with an identical set of protrusions 4-1A through 4-6A, and 5-1A and 5-2A which are exactly matching, such that when the housing parts 1 and 1A are assembled together, these protrusions extend entirely across the enclosed space defined by the housing parts 1 and 1A.

A full-height series of asymmetric protrusions 6-1, 6-2, 6-3 are also provided, as well as a half-height protrusion 6-4, which together with certain of the battery guide protrusions form a contact strip guide pattern for first and second contact strips to be described hereinafter.

Protrusion 6-1 is adjacent the bulb mounting seat protrusion 7 spaced just beyond the end face 27 such as to define a gap able to receive a contact strip, as will be described.

The protrusion 6-2 is located centered between battery support protrusions 4-3 and 4-4, and forwardly thereof to allow the second contact strip to be mounted therein.

The protrusion 6-3 is located aligned with the protrusion 2-3A of the upper housing part 1A, with a gap therebetween. Similarly, the protrusion 6-3A of the upper housing part 1A is closely positioned aligned with the protrusion 23 of the lower housing part 1 of the gap therebetween. Only the lower pair of protrusions 2-3 and 6-3A furthest away from the lightbulb are actually employed, whereas the other pair included are nonfunctional.

The intermediate half-height protrusions 6-4 and 6-4A abut each other and are aligned between the half-height battery guide protrusions 4-5 and 4-6, with a slight gap therebetween to also receive the first battery contact strip.

Finally, each housing part 1 and 1A has a molded retention tab 9 and 9A having a hooking feature 28 and 28A oppositely facing when the housing parts 1, 1A are oriented for assembly.

The inside face of each feature 9 and 9A is located just on one side of the center line such that with the housing parts 1 and 1A oriented for assembly, the inside faces will lie in approximately the same plane, allowing overlap of the hooking features 28 and 28A to create a snap lock.

The height of each of the locking features 9 and 9A is such that the hooking features 28, 28A will just move past each other as the rims 20 come into abutment such as to lock the housing halves together. Separation of the housing parts 1, 1A as for battery or bulb replacement is accomplished with a screwdriver extended into one of the access openings 26 or 26A.

Figure 2:
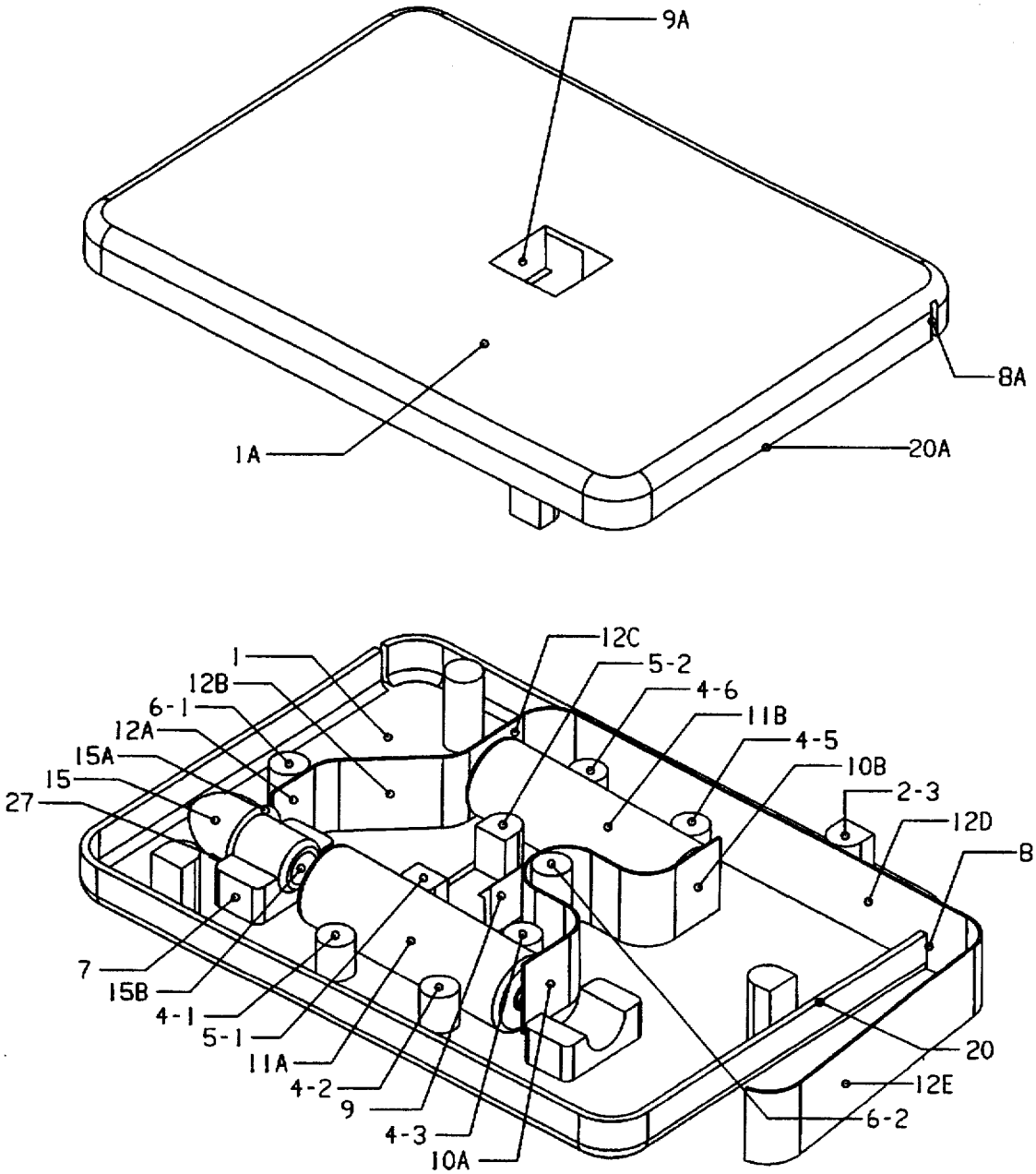
FIG. 2 is an isometric view of the lighting device as shown in FIG. 1, with two housing parts separated but with all of the internal components of the lighting device according to the present invention in place in one of the housing parts, and with a switching strip contact in an unconfined condition allowing battery power to be supplied to the bulb.

FIGS. 2 and 3 show two batteries 11A and 11B installed between the sets of protrusions 4-1, 4-2, 5-1, 4-3, 4-6, 4-5, 4-4 (not visible), and 5-2.

A bulb 15 is installed in the bulb seat protrusion 7.

A first contact strip 10 is generally hat-shaped having straight end sections 10A and 10B, which overlie the terminal 31 of the first battery 11A, and terminal 32 of the second battery 11B, with the central curved section passing around full-height protrusion 6-2.

The first contact strip 10 is configured such as to urge the sections 10A and 10B firmly against the first and second battery terminals 31 and 32 when in position on the pedestal 6-2 to establish an electrical connection therebetween.

The second contact strip 12 is very generally U-shaped, shown installed with a first straight section 12A extending between the full-height protrusion 6-1 and the bulb rim 15A abutting surface 27 of the bulb seat protrusion 7, the edge thereof overlying the bulb rim 15A to establish an electrical contact.

The contact strip 12 is also formed with an offset section 12B extending to a second straight section 12C overlying and pressed against a terminal of the second battery 11B.

The second contact strip 12 is preformed to have a relaxed state such that with the first straight section 12A wedged between the surface of the protrusion 6-1 and the surface 27 of the bulb seat 7, the second straight section 12C is urged firmly against the terminal 30 of the second battery 11B.

A third straight section 12D acts as an extension, passing out through the slot formed by aligned slits 8 in the rims 20, 20A of the housing parts 1, 1A, with a final switching actuator section 12E extending normally to the extension 12D, such as to extend alongside the end of the housing parts 1 and 1A.

The extension 12D passes between the pairs of half height protrusions 4-5, 4-5A, 4-6, 4-6A, and 6-4, 6-4A as best seen in FIG. 3, and also the full height protrusion 2-3 and 6-3A.

The second contact strip 12 is made of an electrically conductive metallic material such as brass, and is resiliently deformable. Displacement of actuator section 12E by closing movement of the closure (FIG. 5) of the enclosure, causes the intermediate section 12B to be resiliently deflected away from the terminal 30 of the second battery 11B. This interrupts the electrical battery circuit powering the bulb 15, and upon opening of the door closure 34 (FIG. 4) and release of the switching actuator 12E, the second contact strip 12 will relax and again be held in contact with the terminal 30 to cause the bulb to be energized.

The batteries 11A, 11B are restrained against movement away from the second contact strip 10 by the straight section 12C of the second contact strip 12 and by the lamp base 15B held by the straight section 12A of the second contact strip 12.

Thus, the first and second batteries 11A and 11B are connected in series and the combined voltage is applied to the bulb 15 with the second contact strip section 12C seated against the terminal 30 to complete the battery circuit.

Figure 6:
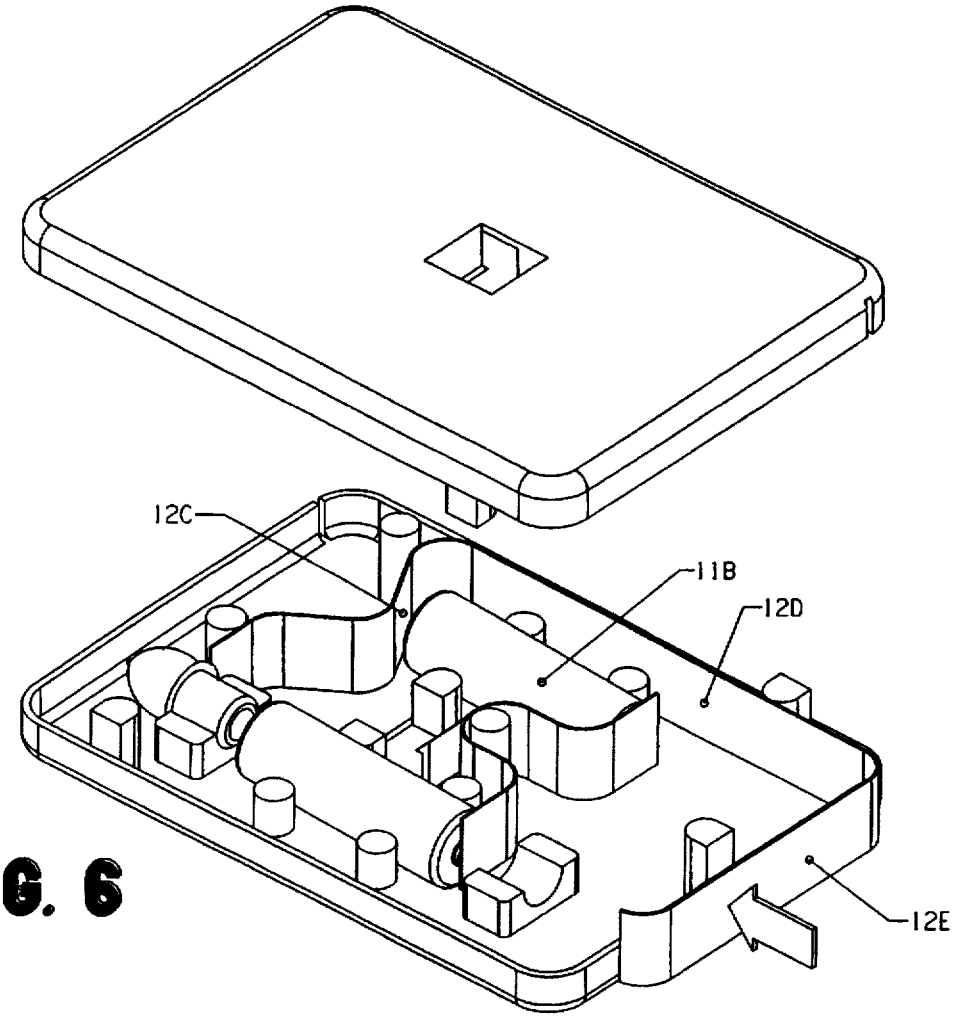
FIG. 6 is an isometric view of the lighting device with the upper housing part separated to illustrate the internal components in the condition existing with the enclosure door closed to switch off the light.

The switched off condition is shown in FIG. 6 in which the second contact strip 12 has been deflected by movement of the switching actuator section 12E causing resilient bending of the straight section 12C to open the battery circuit.

FIGS. 4 and 5 illustrate the installation of the lighting device 40 to an underside of the shelf 18, as an example of a typical use of the lighting device of the present invention. A patch of double-sided foam tape 17 is installed to the backside of the upper housing part 1A in order to position the switching actuator section 12E of the second contact strip 12 protruding forwardly of the forward face of the shelf 18 such as to be normally engaged by a closure door 34 in the closed position.

Figure 7:
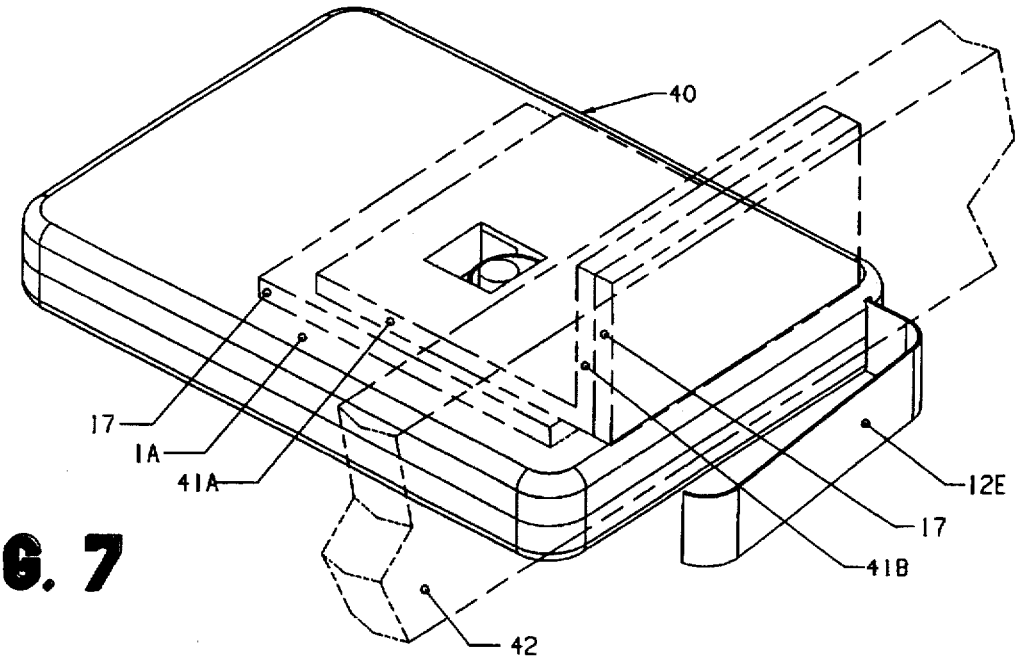
FIG. 7 is an isometric view of the assembled light device optionally positioned behind an enclosure face trim by use of an "ell" bracket.

FIG. 7 illustrates the installation of the lighting device 40 attached to the inward side of a trim board 42 as an optional means for location. The lighting device 40 is attached to one leg 41A of an ell bracket 41 by means of double sided foam tape 17. The other leg 41B of the ell bracket 41 is attached to the inward surface of the enclosure trim board 42 by means of double sided foam tape 17.

Thus, an extremely simple design is provided, comprised of a minimal number of parts able to be manufactured at very low cost. A compact trim exterior shape also results, securely enclosing the operative parts.

I claim:

1. A battery-powered lighting device comprising:

a housing formed by two housing part, at least one housing part being translucent, each housing part having a bottom wall and a rim extending about said bottom wall perimeter, said housing parts positioned facing each other with said rim in abutment to form an enclosed space;

locking means holding said housing parts together;

a pair of elongated batteries in said housing enclosed space, each battery having a terminal at either end thereof;

a pattern of battery guide protrusions extending between an inside of said bottom wall of each of said housing parts, said protrusions locating said pair of elongated batteries side-by-side;

a bulb seat protrusion projecting from an inside of each housing part bottom wall towards each other;

said bulb seat protrusions each including a seating feature;

a bulb held between said seating features of said bulb seat protrusions, with a base contact thereof held against a terminal of a first one of said batteries at one end thereof;

a first contact strip of electrically conductive material held against an adjacent respective terminal at an opposite end of each of said batteries;

a second contact strip of electrically conductive material extending from a terminal at one end of a second of said batteries to a rim contact on said bulb to complete a battery circuit to said bulb to energize said bulb;

said second contact strip having a section extending out of said housing with a switch actuator portion able to be contacted by a movable structure;

said second contact strap also having a resiliently deflectable portion deflected by inward movement of said switch actuator portion and causing said second contact strip to move out of contact with said terminal at said one end of said second battery, to thereby disconnect said battery circuit.

2. The lighting device according to claim 1 wherein each of said housing parts are of identical shape.

3. The lighting device according to claim 1 wherein at least some of said protrusions are asymmetrically located, and said housing parts are rotated 180° with respect to each other when assembled to offset respective corresponding protrusions.

4. The lighting device according to claim 1 further including a series of contact strip guide protrusions formed in said housing parts and projecting into said enclosed space at least in part defining guide surfaces locating said first and second contact strips in said housing enclosed space.

5. The lighting device according to claim 1 wherein said housing parts are each formed with slits in said rim thereof, said slits of each housing part aligned with each other when said parts are assembled to form a slot receiving said second contact strip to allow a portion thereof said second strip to extend out of said housing.

6. The lighting device according to claim 2 wherein at least some of said protrusions on respective housing parts are disposed in a mirror image pattern with said housing parts rotated to face each other.

7. The lighting device according to claim 1 wherein said locking means comprises a locking tab projecting from said housing part bottom wall, said locking tabs each having a hooked portion snap-fit over each other to hold said housing parts together.

8. The lighting device according to claim 7 wherein each housing part is formed with an access opening adjacent a respective locking tab to enable release thereof.

9. The lighting device according to claim 1 wherein each housing part is a molded plastic piece.

10. The lighting device according to claim 9 wherein said plastic pieces are of light transmitting material, and said bulb is completely enclosed within said housing enclosed space.

11. The lighting device according to claim 1 wherein said second contact strip is generally U-shaped, including an end opposite said switch actuator portion seated on said bulb rim contact, a portion adjacent said end seated against one of said strip contact guide protrusions so as to resist movement by inward movement of said switch actuator portion, an extension portion connected to said switch actuator portion, and an intermediate portion extending normally to said extension portion and into contact with said terminal of said second battery, said intermediate portion held by said adjacent portion thereby deflected away from said terminal by movement of said switch actuator and extension portions.

* * * * *